United States Patent [19]

Huey et al.

[11] Patent Number: 4,461,448

[45] Date of Patent: Jul. 24, 1984

[54] WELL BLOWOUT PREVENTER, AND PACKING ELEMENT

[75] Inventors: Wai Huey, Los Angeles; Fernando Murman, Rancho Palo Verdes; Eugene Matsuda, Laguna Hills, all of Calif.

[73] Assignee: Hydril Company, Los Angeles, Calif.

[21] Appl. No.: 277,341

[22] Filed: Jun. 25, 1981

[51] Int. Cl.[3] ..... E21B 33/06

[52] U.S. Cl. ..... 251/1 B; 277/121

[58] Field of Search ..... 251/1 R, 1 B, 333; 277/73, 121

[56] References Cited

U.S. PATENT DOCUMENTS

| | | | |
|---|---|---|---|
| 2,038,140 | 4/1936 | Stone | 277/34.3 |
| 2,124,015 | 7/1938 | Stone | 277/2 |
| 2,148,844 | 2/1939 | Stone | 277/73 |
| 2,163,813 | 3/1939 | Stone | 277/2 |
| 2,287,205 | 6/1942 | Stone | 277/28 |
| 2,609,836 | 9/1952 | Knox | 277/73 |
| 3,063,467 | 11/1962 | Roberts | 251/333 |
| 3,225,831 | 12/1965 | Knox | 166/75 R |
| 3,323,773 | 6/1967 | Walker | 251/1 R |
| 3,486,759 | 12/1969 | Lewis | 277/73 |
| 3,533,468 | 10/1970 | Lewis | 166/363 |
| 3,591,125 | 7/1971 | Lewis | 251/1 R |
| 3,917,293 | 11/1975 | Lewis | 277/114 |
| 3,958,808 | 5/1976 | Lewis | 277/1 |
| 4,098,341 | 7/1978 | Lewis | 166/387 |
| 4,098,516 | 7/1978 | Murman | 277/235 R |
| 4,283,039 | 8/1981 | Schaeper | 251/1 |

*Primary Examiner*—Martin P. Schwadron
*Assistant Examiner*—J. R. Shay
*Attorney, Agent, or Firm*—William W. Haefliger

[57] ABSTRACT

A well blowout preventer packer unit is characterized by long life, and induced back to front (radial) rubber feeding between metallic inserts to close on well pipe for producing a pressure gradient against the pipe which is greatest at the bottom of the packer extent engaging the pipe, and lowest at the top of the packer extent engaging the pipe.

62 Claims, 18 Drawing Figures

WELL BLOWOUT PREVENTER, AND PACKING ELEMENT

BACKGROUND OF THE INVENTION

This invention relates generally to well blowout preventers, and more particularly concerns packer units used in such equipment.

For many years, the design of blowout preventer packing units has followed the principles described in U.S. Pat. No. 2,609,836 to Knox. Such units incorporate like metal inserts equally spaced about the packer central axis, and embedded by an elastomeric body. Upon inward constriction or closure of the unit about a well drill pipe, the material is anchored by insert webs as it produces vertical folds stretching radially inwardly to seal against the pipe. In general, the number of folds will equal the number of inserts, and they will be alike in circumferential contour. When the packer unit insert close on itself, with no pipe present, the elastomeric material of the folds advancing toward the axis must at certain times and places stretch or extend as much as 350 to 400%. Repeated closures produce excessive wear and fatigue of the elastomeric or rubber material, reducing the useful life of the packer due to such extreme stretching. Also, the rubber quality must be extremely closely controlled to ensure successful closure and seal-in thousands of pounds per square inch of well fluid pressure. Accordingly, there is a need for a packing unit characterized by significantly reduced rubber stretching, and the useful life of which will be extended over many more closures than conventionally possible.

Another problem with packer design has to do with damage to the rubber that tends to flow or extrude into the spaces between like end-plates on the insert webs, as the plates move relatively inwardly and toward one another during packer constriction.

An improved packer unit is described in U.S. Pat. No. 3,917,293 to Lewis et al. That patent discloses, among other things, the use of alternately different web plates to control packer constriction.

SUMMARY OF THE INVENTION

It is a major object of the invention to provide a packer unit, packer annulus, packer inserts and blowout preventer employing same, all of unusual configuration and improved construction, overcoming the above problems and meeting the described needs.

Basically, the invention contemplates improvements in controlling flow of elastomeric material during packer constriction under application of well pressure; differential closing movement of the packer unit induced by differential compression of the packer material by the closing piston; and reduction in stress levels in the energized rubber or elastomer, during its inward flow, by reduced deformation under pressure. These objectives are achieved, as will appear by providing one or more of the following:

(a) the provision of a packer elastomer annulus having a first body section to be radially inwardly compressed by the piston during its axial advancement while a second body section of the annulus is axially compressed into engagement with inner surface extent of the housing, the two body sections remaining integral;

(b) angularity of the piston and packer cam surfaces aiding the differential compression of the annulus as referred to;

(c) the provision of collapsible recesses in the elastomeric material to selectively fill with such material during packer constriction, and close off;

(d) the provision of metallic inserts co-acting with the elastomeric material to resist extrusion of elastomeric material relatively upwardly, and induce inward displacement of such material at a relatively low level;

(e) the provision of additional unusually advantageous features of construction, and related to the above, and in addition thereto.

As a result, the packer unit has long life making it particularly useful for sub-sea and deep well drilling. Back to front (radial rubber feeding characteristics during closing of the packer facilitate closing on virtually any shape on the drill string, and stripping of tool joints, under pressure, to produce a pressure gradient against the drill pipe which is greatest at the bottom of the packer extent engaging the pipe, and lowest at the top of the packer extent engaging the pipe. Also, less force is required to close the packer than is characteristic of prior packer units of the same size.

These and other objects and advantages of the invention, as well as the details of an illustrative embodiment, will be more fully understood from the following specification and drawings, in which:

DRAWING DESCRIPTION

Figure 6:
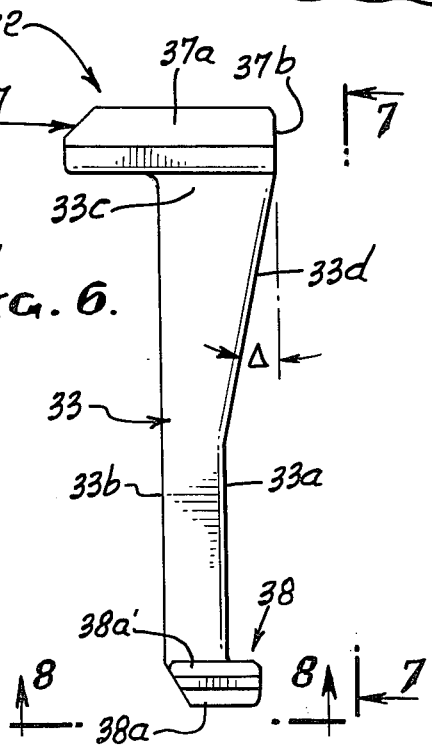
Figure 7:
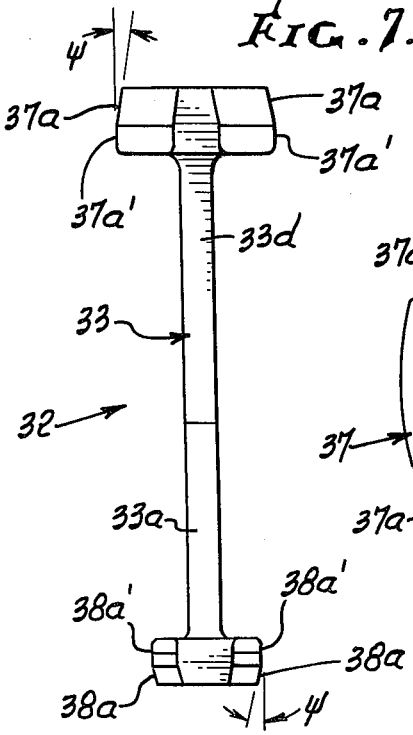
Figure 8:
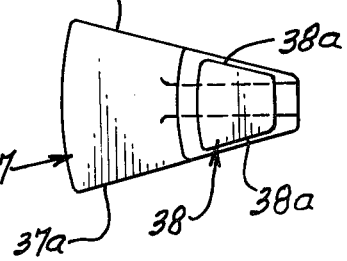
Figure 3:
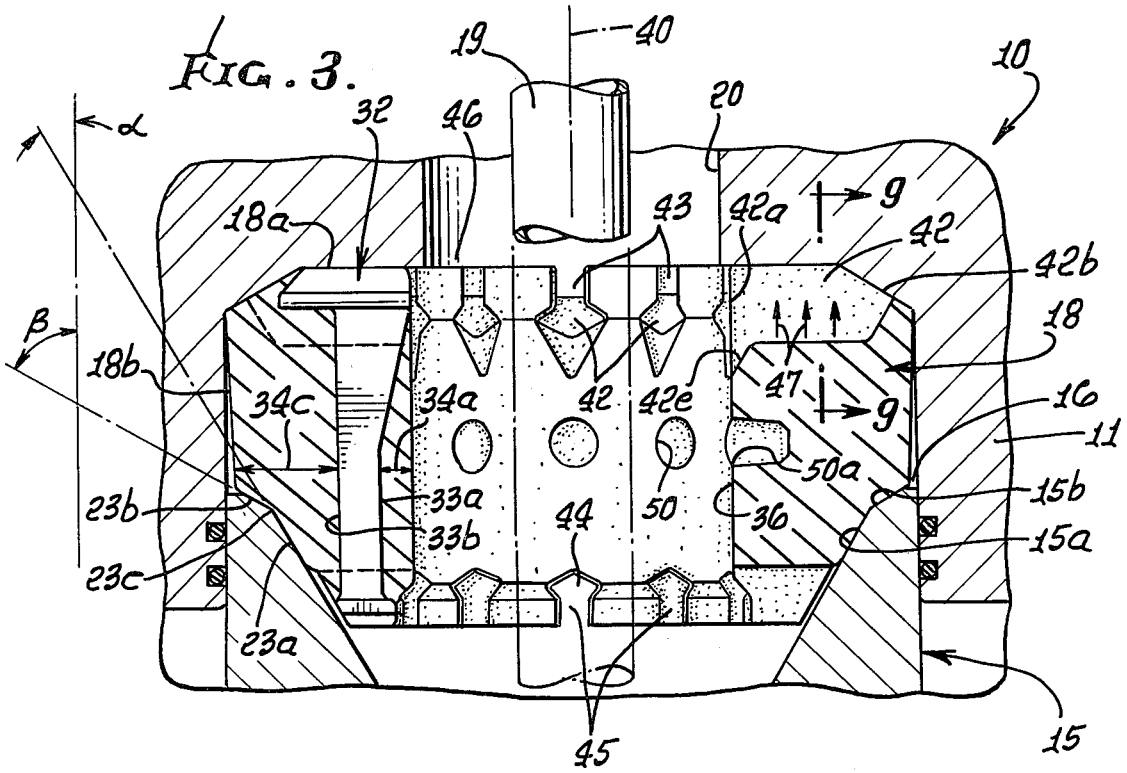
FIG. 3 is an elevation taken in section on lines 3—3 of FIG. 2.
Figure 3A:
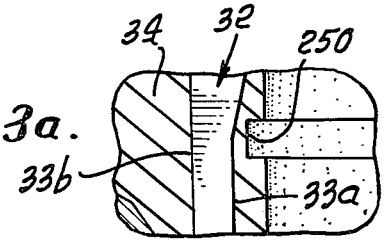
Figure 4:
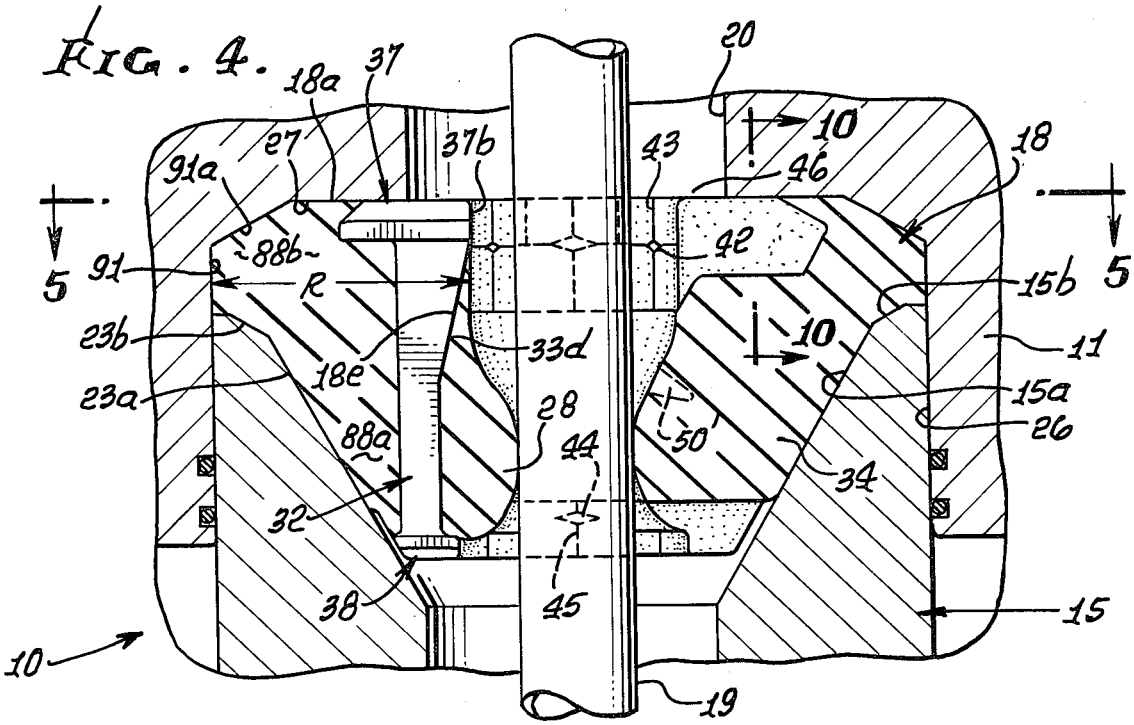
Figure 5:
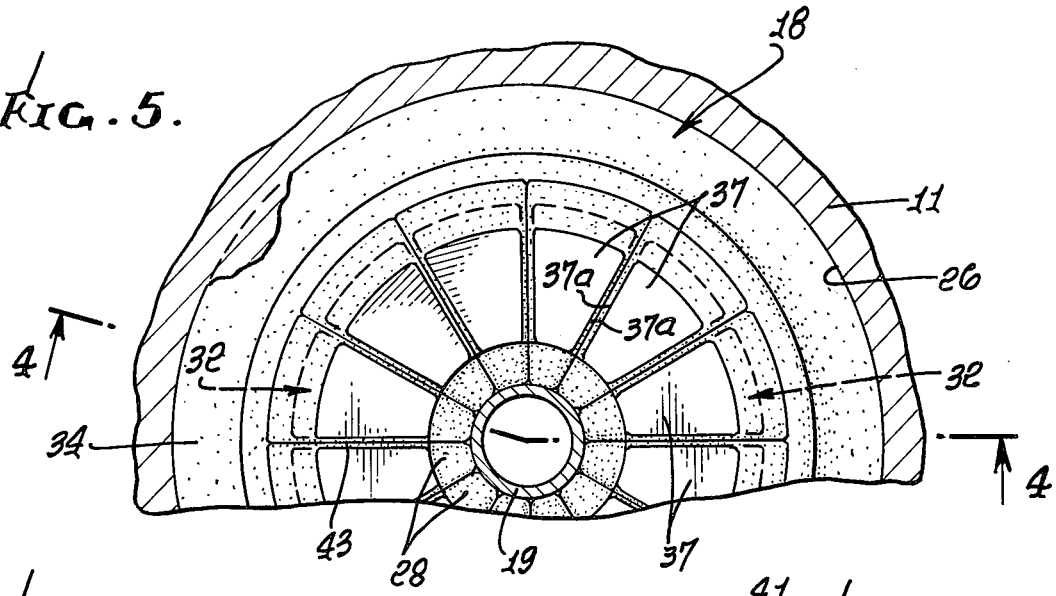
Figure 9:
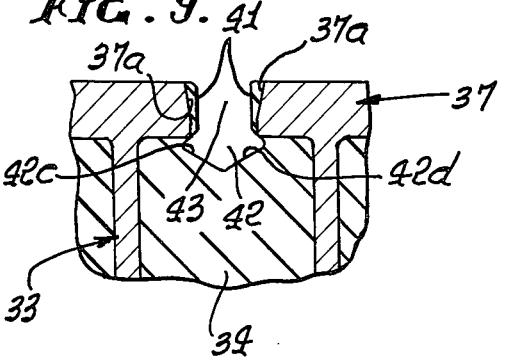
Figure 10:
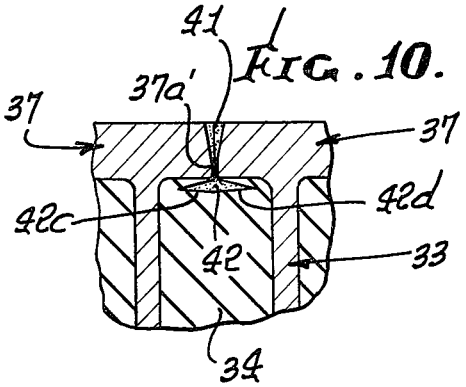
Figure 11:
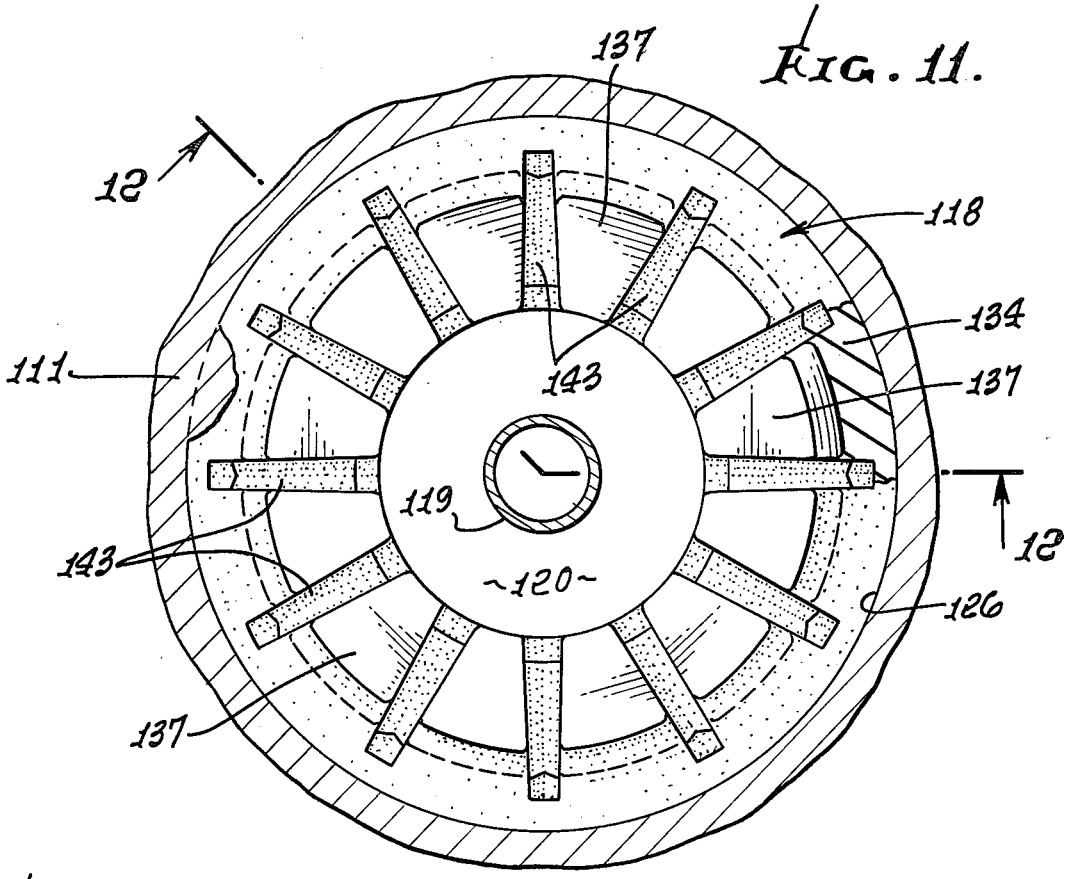
Figure 12:
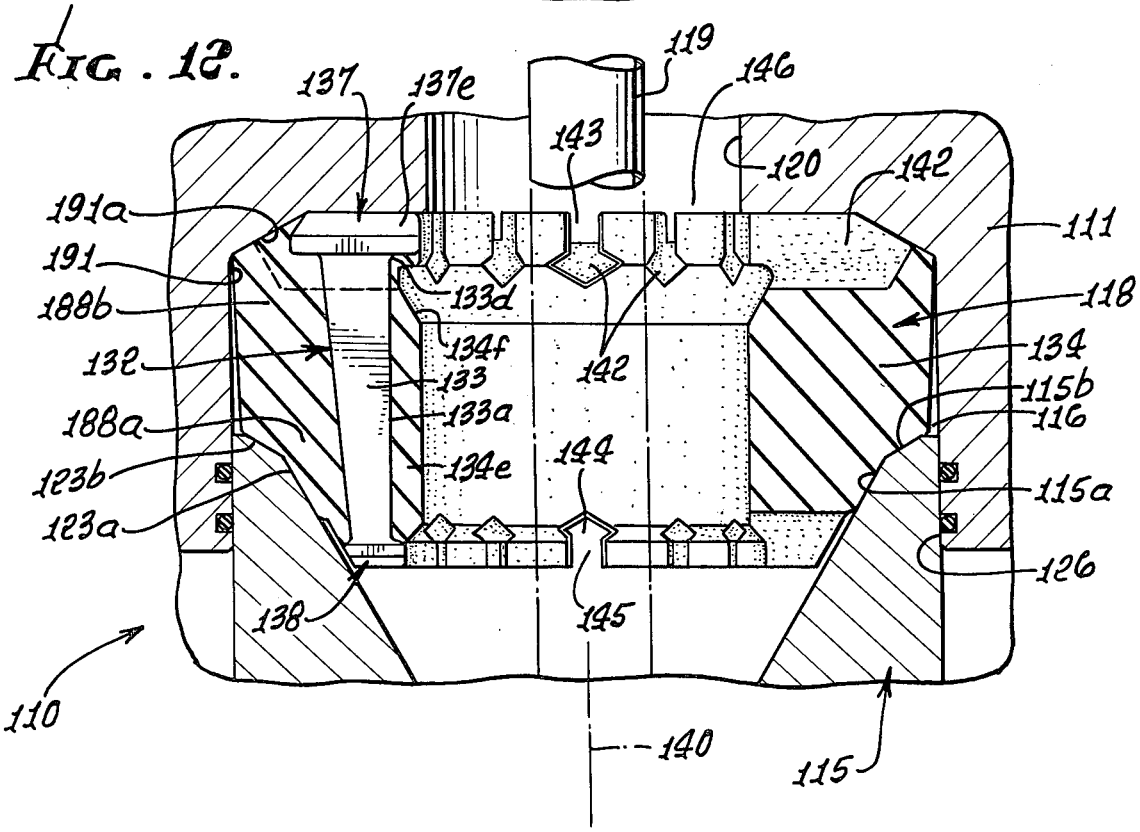
Figure 14:
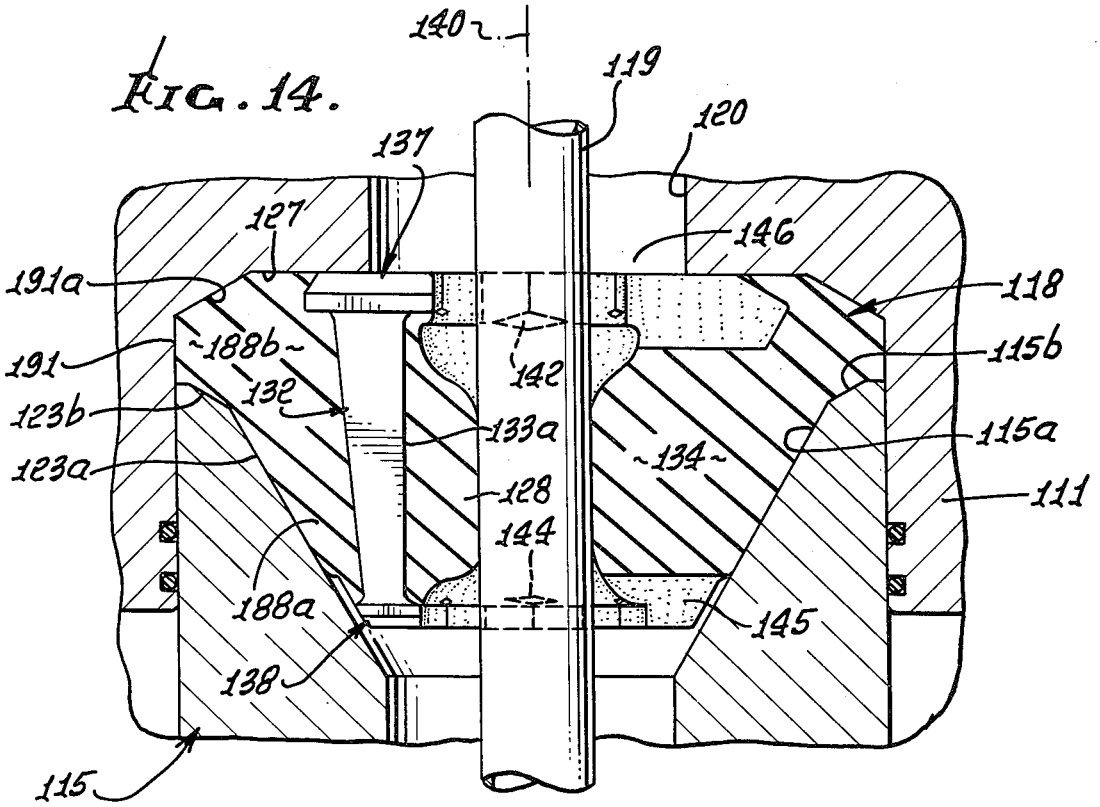
Figure 13:
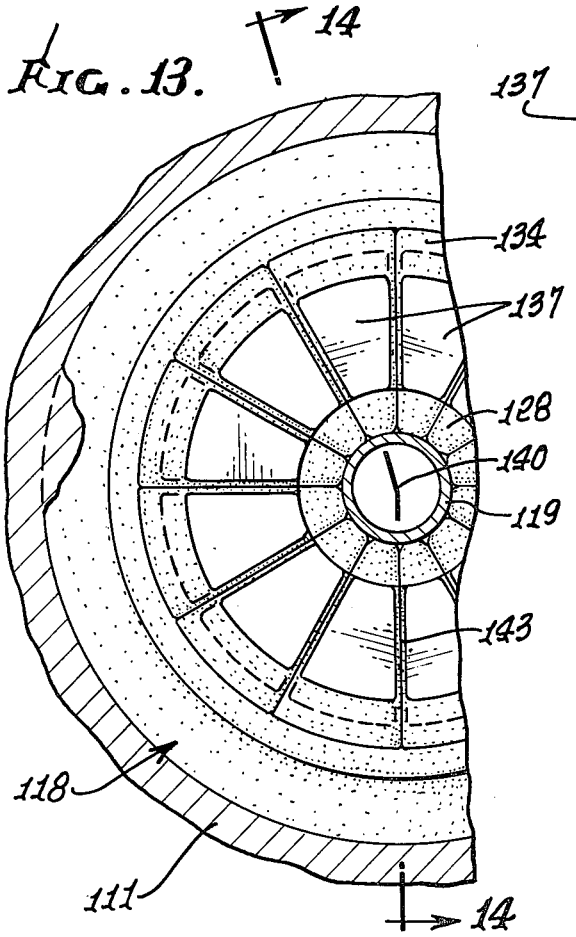
Figure 15:
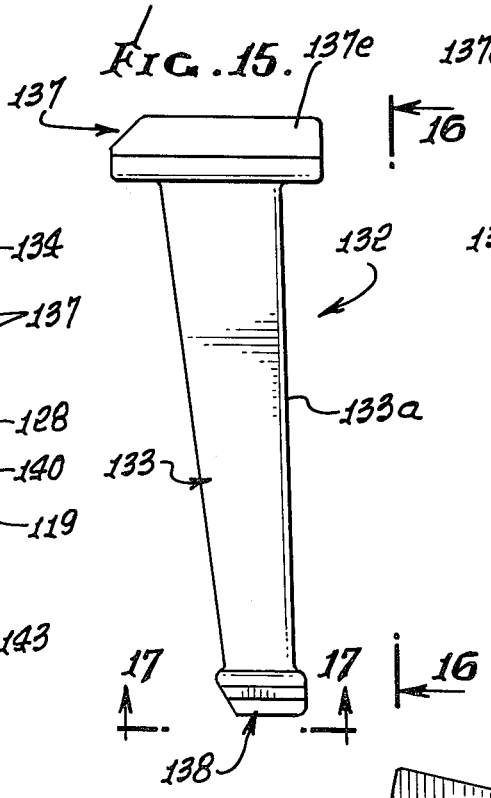
Figure 16:
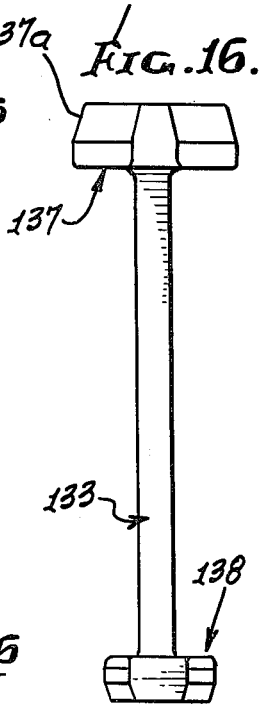

FIG. 3*a* is a fragmentary view showing a packer recess;

FIG. 4 is a view like FIG. 3 showing the packer in partly closed condition;

FIG. 5 is a plan view taken in section on lines 5—5 of FIG. 4;

FIG. 6 is an enlarged side elevation showing an insert as employed in the unit of FIGS. 1-5;

FIG. 7 is an end elevation taken on lines 7—7 of FIG. 6;

FIG. 8 is a bottom plan view taken on lines 8—8 of FIG. 6;

FIG. 9 is an enlarged section taken in elevation on lines 9—9 of FIG. 3;

FIG. 10 is a view like FIG. 9, but taken on lines 10—10 of FIG. 4;

FIG. 11 is a plan view of a modified packer unit, in open condition;

FIG. 12 is an elevation taken in section on lines 12—12 of FIG. 11;

FIG. 13 is a plan view of the packer of FIGS. 11 and 12, but showing it in partly closed condition;

FIG. 14 is an elevation taken in section on lines 14—14 of FIG. 13;

FIG. 15 is an enlarged side elevation showing a modified insert as employed in the unit of FIG. 11-14;

FIG. 16 is an end elevation taken on lines 16—16 of FIG. 15; and

Figure 17:
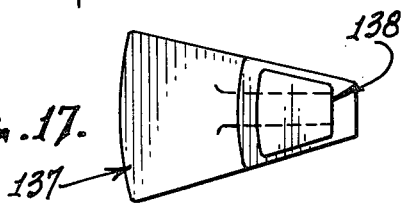

FIG. 17 is a bottom plan view taken on lines 17—17 of FIG. 15;

DETAILED DESCRIPTION

Figure 1:
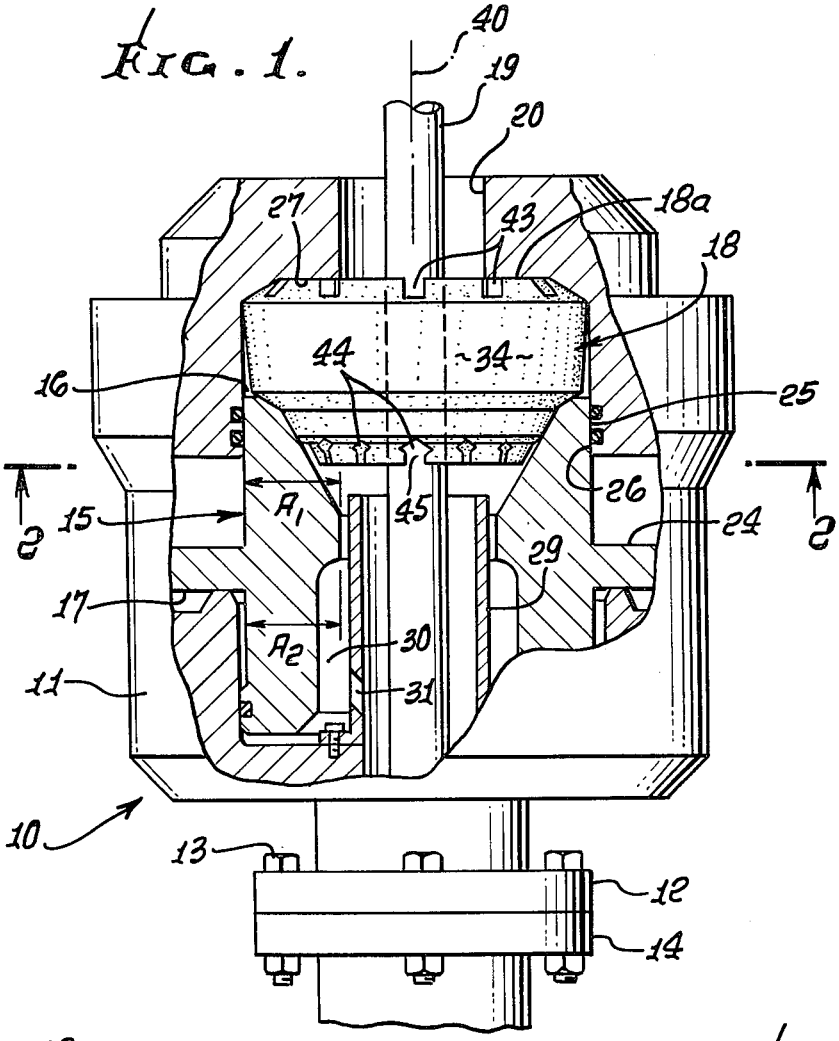
FIG. 1 is an elevation partly in section, showing use of the new packer unit in a blowout preventer assembly.

Referring to FIG. 1, a blowout preventer 10 includes a metallic housing 11, the lowermost extent of which shown flanged at 12 and bolted at 13 to well head casing flange 14, or other well head equipment. The housing, which may have various configurations, typically contains a piston 15 movable upwardly in chamber 16 in response to fluid pressure exertion upwardly against piston face 17. Such piston movement serves to constrict an annular packer unit 18 via pressure exertion from piston interior cam surface extent against exterior surface extent of the packer.

In accordance with an important aspect of the invention, the annulus has a first body section (as at 88*a*) to be radially inwardly displaced by the piston during its axial advancement (see radial inward bulge 28 in FIG. 4) and a second body section (88*b*) to be axially compressed by the piston during its advancement, so that the second body section compressively engages inner wall surface extent (as at 91 and 91*a*) of the housing during piston advancement. Note that wall 91*a* is frusto-conical, to aid inward feeding of the elastomer at an upper location subsequent to formation of the lower annular bulge 28.

In accordance with another aspect of the invention, the annulus exterior cam surface extent engageable by the piston has angularity which varies in axial radial planes, whereby initial radially inward constriction of successive portions of the packer is enhanced per unit upward displacement of the piston, for faster closing, whereas final inward constriction of successive portions of the packer (as during sealing of the packer about a well pipe) is slowed or reduced to realize a higher mechanical advantage and greater sealing force application, per unit upward displacement of the piston. Note that the piston in FIGS. 3 and 4 "penetrates" the packer, radially outwardly of inserts 32 to be described.

In the example, the packer annulus exterior cam surface extent includes a first frusto-conical portion 23*a* of lesser angularity $\alpha$ relative to the central axis 40 (or lines parallel thereto) and a second frusto-conical portion 23*b* of greater angularity $\beta$ relative to that axis, these being radially outwardly spaced from web surfaces 33*a* and 33*b* to be described. As shown, portions 23*a* and 23*b* intersect at circular region 23*c*, and portion 23*b* is closer to the packer top surface 18*a* than portion 23*a*. Region 23*c* may be concavely curved.

Similarly, the piston 15 has interior cam surface extent engaging the exterior cam surface extent of the packer, and the piston cam surface extent has varying angularity matching that of the annulus cam surface extent, as described, and during upward displacement of the piston. In the example, the piston has a first interior frusto-conical surface portion 15*a* of relatively less angularity $\alpha$ relative to axis 40, in axial radial planes, and engaged with packer surface portion 23*a* and the piston also has a second interior frusto-conical surface portion 15*b* of relatively greater angularity $\beta$ relative to axis 40, and in axial radial planes, and engaged with packer surface portion 23*b*. Typically, angle $\alpha$ may be less than 45°; angle $\beta$ may be greater than 45°; and the difference $\Delta$ between the two angles $\alpha$ and $\beta$ can be in excess of 15°. Other angles are possible.

Surfaces 15*a*, 15*b*, 23*a* and 23*b* are flared upwardly, as shown.

FIG. 4 shows the progressive inward displacement of the packer elastomeric material during piston upward movement, lower annular bulge being first created at 28, inward bulging then progressing upwardly as the piston moves upwardly. The packer, when sufficiently radially inwardly displaced, seals off about a well pipe 19 shown extending axially vertically through the preventer 10. Since the closing of the packer is from the bottom upwardly, the pressure gradient against the pipe is greatest at the bottom and lowest at the top of the packer extent engaging the pipe, which is consistent with the occurrence of highest well fluid pressure at the underside of the packer, and no well pressure at the top of the packer. In the absence of the pipe, the packer unit 18 will completely close off the vertical passage 20 through the preventer, when the unit is sufficiently constricted by the piston 15. Note in FIG. 4 that the second body section 88*b* has greater overall radial dimension "R" in piston advanced position than in piston retracted position (see FIG. 3).

Figure 2:
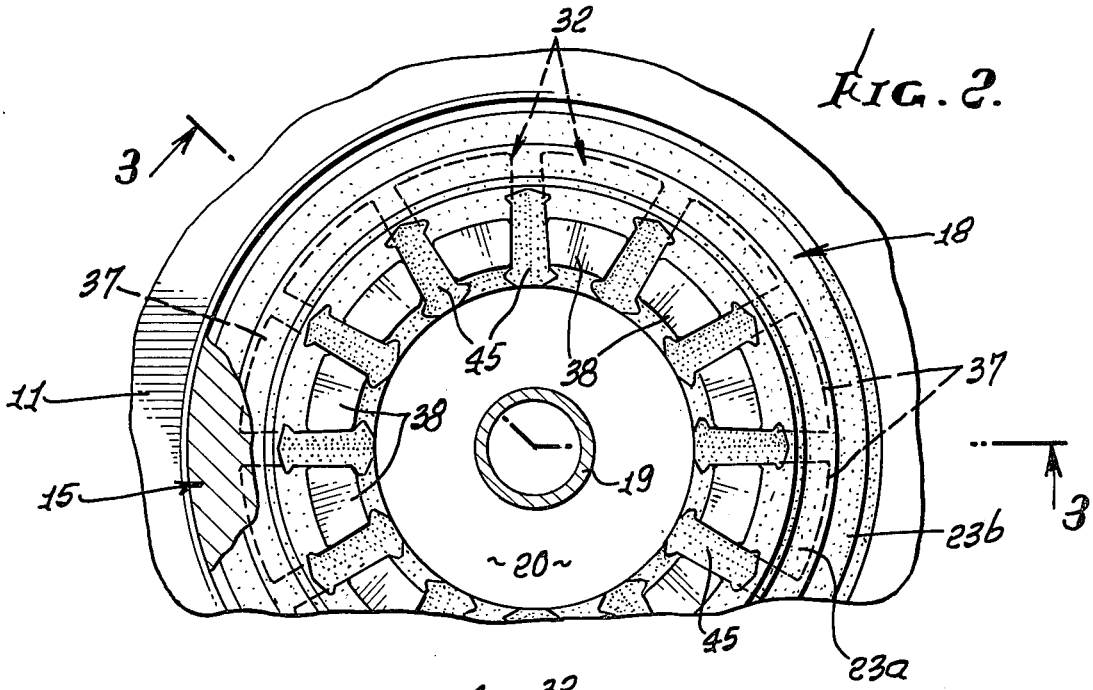
FIG. 2 is an enlarged horizontal section, taken on lines 2—2 of FIG. 1.

Upon downward movement of the piston in response to fluid pressure exertion against face 24, the packer expands radially outwardly to open position as seen in FIGS. 1 and 2. Note that the piston annular surface 25 may have guided sliding engagement with housing cap bore 26, and that the packer unit is normally confined vertically beneath the housing cap lower interior surface 27.

The above functions are further enhanced by making the slant height lengths of cam surfaces 15*a* and 23*a* substantially greater than the slant height lengths of cam surfaces 15*b* and 23*b*.

FIG. 1 also shows that the overall horizontal, annular, upwardly projected cross-sectional area $A_1$ of the piston is approximately equal to the overall horizontal, downwardly projective cross-sectional area $A_2$ exposed to well fluid pressure. This assures a pressure balanced condition at the piston and packer, prior to packer constriction. Note that well fluid pressure gains access to the space 30 at the underside of the piston, via openings 31 in tubular stem 29.

The packer is unit 18 includes metallic inserts, as at 32, generally circularly spaced about the center vertical axis 40, the inserts having webs 33 that extend generally longitudinally vertically; also the unit includes annulus 34 of elastomeric material extending about axis 40 and embedding the webs, so that they anchor the elastomeric material during inward compressive displacement of the packer unit. Typically, the rubber is bonded to the metallic inserts. The elastomeric material may consist for example of natural or synthetic rubber. The radial thickness of the elastomer material at 34*a* between the vertical inner edges 33*a* of the webs and the packer bore 36 is less than the radial thickness of the material at 34*c* between the vertical outer edges 33*b* of the webs and the outer periphery 18*b* of the packer annulus. Note that the upper extents 33*c* of the webs 33 have inner surfaces or edges 33*d* facing radially inwardly toward axis 40. Those inner edges or surfaces extend downwardly and outwardly at an angle $\Delta$ (see FIG. 6) relative to vertical, to resist upward displacement of packer material therebelow, in response to inward displacement of the packer by the piston. FIG. 4 shows this condition, with the packer partly closed, but the elastomeric material bulging inwardly at 28, i.e. at a lower level than the levels of edges or surfaces 33*d*. Packer material 18*e* adjacent the latter may be bonded thereto. Accordingly, upward displacement of packer material by well pressure beneath bulge 28 is resisted, with enhanced effect.

Note that web surfaces 33*d* extend upwardly into proximity with and preferably adjacent the radially innermost extents 37*b* of upper plates 37 integral with the tops of the webs. The inserts also have lower or bottom plates 38 integral with the bottoms of the webs. The plates 37 are circularly spaced about axis 40, as are plates 38. Opposite sides 37*a* of plates 37 are formed to interfit, or nearly interfit, during closing of the packer, as appears in FIGS. 5 and 10; however, thin bands 41 of elastomer may be bonded to each such side, as in FIG. 9, to be squeezed as the adjacent plates approach interfit condition. Similarly, opposite sides 38*a* of the lower plates are formed to interfit, or nearly interfit, during closing of the packer, but prior to complete closure. Sides 37*a* taper inwardly toward axis 40, as to sides 38*a*. Also, sides 37*a* taper upwardly, as seen in FIGS. 7–10; and sides 38*a* taper downwardly, such taper angularity $\psi$ from vertical being less than about 10°. Lower portions 37*a'* of sides 37*a* most closely approach one another during closure, and upper portions 38*a'* of sides 38*a* most closely approach one another during closure, thereby sealing off associated recesses 42 from slots 43, and recesses 44 from slots 45. The squeezing of rubber layers or bands 41 (see FIG. 10) also closes slots 43 and seals off recesses 42.

In accordance with another important aspect of the invention, the annulus 18 contains recesses spaced about axis 40 and extending generally radially outwardly from intersections with the annulus bore, such recesses adapted to be constricted in response to inward displacement of the packer unit, to aid anchoring of the packer material against extrusion upwardly past the packer unit upper surface 18*a*, i.e. into region 46 in FIG. 3. In the example, recesses 42 are formed in the packer elastomeric material to extend from intersections 42*a* with the packer bore 36 to intersections 42*b* with the packer exterior. The recesses 42 have polygonal cross sections in planes normal to their generally radial directional extents, as is clear from FIG. 9. Such polygons may be generally diamond shaped, with downwardly converging recess walls 42*c* and 42*d*. During inward displacement of the packer, walls 42*c* and 42*d* are upwardly displaced by flow of excess elastomeric material to collapse such recesses, as is clear from FIG. 10. See also upward rubber flow arrows 47 in FIG. 3. Slots 43 communicating between the tops of the recesses and the top surface of the packer are also collapsed, as described above, sealing off the recesses to prevent upward extrusion of packer material from the recesses, whereby the further flow of packer material is thereby directed radially inwardly to seal off against the well pipe 19 at the general level of the recesses, and during final closure of the packer. Note enlarged mouths 42*e* of recesses 42, in FIG. 3, to aid rubber flow as described.

Similarly, the lower recesses 44 are collapsed downwardly toward slots 45 as rubber flows into such recesses 44 during inward constriction of the packer.

It will be noted that the set of recesses 42 is axially spaced from the set of recesses 43 and is also axially spaced from the first and second frusto-conical surface portions 23*a* and 23*b* of the packer, but closer to surface portion 23*b* than to surface portion 23*a*. Also, each recess 42 and slot 43 combination has "keyhole" configuration, as does each recess 44 and slot 45 combination.

The illustrated packer may contain additional recesses 50 spaced about axis 40 and extending generally radially outwardly from intersections 50*a* with the annulus bore. Recesses 50 may be located at a level or levels intermediate the levels of the two sets of recesses 42 and 44, and are adapted to fill with excess packer elastomeric material during inward constriction of the packer, thereby assisting in confining the initial bulge formation to a relatively lower level, as is clear from FIG. 4. Compare the full size of recess 50 in FIG. 3, with its reduced size 50' in FIG. 4. The number of recesses 50 may equal the number of recesses 42, and they may have generally circular cross sections in planes normal to their radial length directions.

The packer unit 118 shown in FIGS. 11–14 is generally the same as that in FIGS. 1–5, excepting for the inserts 132. The latter have webs 133 with vertical inner sides or edges 133*a* everywhere between upper and lower plates 137 and 138. The upper plates 137 have radially inward extents 137*e* which overhang the webs, in radially inward directions. The annulus 134 of elastomeric material extends at 134*e* inwardly of the innersides 133*a* of the webs, and upwardly toward the overhanging extents of the upper plates, to flare at 134*f* generally toward the intersections 133*d* of the web innersides and the upper plate undersides. As a result, upward extrusion of elastomeric material into bore region 146 is prevented due to retention of that material below the upper plate overhanging extents 137*e*, as assisted by the flow of excess material into the collapsing recesses.

In FIGS. 11–17, the identifying numbers applied to corresponding components are the same as in FIGS. 1–10, excepting for the addition of a hundreds digit to each such number.

In summary, the tall, tapered piston provides a stable and uncomplicated mechanism to provide variable mechanical advantage to variably squeeze the packing element. As hydraulic pressure is applied to the closing chamber of the blowout preventer, the piston is displaced vertically which in turn compresses the rubber reservoir at the back or outer portion of the packing element. As the rubber at the back of the element is being compressed longitudinally, the inserts are driven radially by the compressing rubber toward the center until the top plates of the inserts come together, and the bottom plates of the inserts come together, at which point the inserts lock-up and cease to move further inward, radially. Radial inward displacement of the inserts and of the back rubber reservoir in turn displace the front or inner rubber reservoir of the packing element inward. Closing movement of the inserts acts to displace the rubber between the inserts radially inwardly to feed the front (inner) rubber reservoir. After the inserts lock-up, the lesser taper 15*a* on the piston acts on the back (outer) reservoir of the packing element to feed the rubber between the inserts to the front or inner side of the packing element.

The rubber at the back of the packing element is contained at all times by the top contour of the piston and by the contour of the underside of the head. Since the back (outer side) of the packing element is always contained and always in compression, rubber breakages are prevented. The relative placement of the inserts in relation to the cross-section of the packing element and the cam surfaces of the piston and packer enable the inserts to move quickly radially inwardly in respect to the rubber to reach the predetermined lock-up diameter. This lock-up diameter is at a minimum to minimize the extrusion gap between the plates of the inserts and the pipe to be sealed off. The smaller extrusion gap enhances packing element longevity.

The keyhole-like configurations of the recesses between the flanges of the inserts, prevent rubber from migrating up between and being pinched between the plates as the inserts move radially prior to lock-up. Thus, the keyhole reliefs allow the insert plates to come together to form a continuous metal barrier. Only the annulus area between the insert plates and the pipe remains for entry of rubber under well pressure.

The inserts are configured so that shearing stresses and stress risers are minimized. The top front contour of the web provides a bond restraint against vertical rubber displacement. The gradual frontal transition of the web to the insert top plate materially reduces well pressure induced rubber breakages. Elimination of back breakage problem allows for greater freedom insert design. The insert web can be narrowed to provide lower compression stresses. Maximum front elastomer fiber lengths are located at the bottom portion of the insert. The insert bottom frontal web is vertically straight which allows for equal rubber fiber elongation in front of the insert. This configuration allows the packing element to pack-off at a low level in respect to the packing element height. Low pack-off, together with the bond restraint of the web front transition contour, minimizes vertical rubber displacement under well pressure.

The described additional, intermediate recesses help reduce rubber stresses by reducing the shape factor during compression. Such recesses essentially divide the packing element into two packing elements in series, but confined into one unit. An annular groove may be substituted for, or added to, such recesses, as appears at 250 in FIG. 3*a*.

Since the back of the packing element is fully contained, the compressed rubber reacts against the action of the piston. Since the rubber reacted hydraulic area of the piston is essentially equal to the hydraulic area of the piston underneath exposed to well fluid pressure, the packing element and the blowout preventer operations are completely independent of hydrostatic forces causes by water depths and/or drilling fluid weights in subsea operations. Thus, the packing element and the blowout preventer are suitable for both onshore and offshore applications.

We claim:

1. In an annular blowout preventer packer unit having a longitudinal axis, the packer unit adapted to be compressed during axial advancement of a piston in a housing, and to engage surface extent of the housing facing inwardly toward said axis, the combination comprising (a) metallic inserts generally circularly spaced about said axis, the inserts having webs that extend generally longitudinally, and (b) an annulus of elastomeric material extending about said axis and embedding said webs so that the webs anchor the material during displacement thereof, the annulus having a bore, (c) the annulus having a first body section located to be radially inwardly displaced by the piston during its axial advancement, and a second body section located to be axially compressed by the piston during its advancement so that the second body section remains compressively engaged against said inner surface extent of the housing during said piston advancement, said first and second body sections being integral and in longitudinal alignment prior to said compression of the packer unit by the piston, (d) said first body section having a first frusto-conical portion of lesser angularity relative to said axis and a second frusto-conical portion of greater angularity relative to said axis, said second portion having greater radial spacing from said axis than said first portion, said portions located radially outwardly of the webs.

2. The unit of claim 1 wherein the unit has upper and lower surfaces, said second portion located closer to said upper surface than said first portion.

3. The combination that includes the unit of claim 1 and said axially movable piston engaging said packer, the piston having interior cam surface extent engaging annulus exterior cam surface extent defined by said first body section radially outwardly of said webs.

4. The combination that includes the unit of claim 2 and an axially movable piston engaging the packer, the piston having a first interior frusto-conical surface portion of relatively lesser angularity in axial radial planes and engaged with said first body portion of the first body section, and the piston having a second interior frusto-conical surface portion of relatively greater angularity in axial radial planes and engaged with said second body portion of said first body section.

5. The unit of claim 1 wherein said annulus contains recesses spaced about said axis and extending generally radially outwardly from intersections with the annulus bore, said recesses adapted to be constricted in response to said inward displacement of the packer unit first body portion.

6. The unit of claim 5 wherein certain of said recesses have polygonal cross sections in planes normal to generally radial directional extents of said certain recesses.

7. The unit of claim 6 wherein said certain recesses terminate at intersections with the packer exterior.

8. The unit of claim 6 wherein said annulus contains slots communicating between an axial end of the unit and said certain recesses.

9. The unit of claim 8 wherein said inserts include plates spaced about said axis and between said slots, and webs spaced about said axis and between said certain recesses.

10. The unit of claim 9 wherein said certain recesses are sized to constrict and block material extrusion into said slots, in response to inward displacement of the packer.

11. The unit of claim 1 wherein said annulus contains first and second axially spaced sets of recesses spaced about said axis and extending generally radially outwardly from intersections with the annulus bore, the recesses adapted to be constricted in response to said inward displacement of the packer unit.

12. The unit of claim 11 wherein the first set of recesses is located radially inwardly of said first portion of said first body section.

13. The unit of claim 12 wherein the second set of recesses is generally axially spaced from said first and second portions of said unit first body section, but located closer to said second portion than to said first portion.

14. The unit of claim 13 wherein certain of said recesses in each set have polygonal cross sections in planes normal to generally radial directional extents of said certain recesses.

15. The unit of claim 14 wherein said certain recesses terminate at intersections with the packer exterior.

16. The unit of claim 14 wherein said annulus contains slots communicating between said certain recesses and axial end portions of said unit.

17. The unit of claim 14 wherein said inserts include plates spaced about said axis and between said slots, and webs spaced about said axis and between said certain recesses.

18. The unit of claim 17 wherein said certain recesses are sized to constrict and block material extrusion into said slots, in response to inward displacement of the packer.

19. The unit of claim 18 wherein the angularity of said second portion of said unit surface frusto-conical extent is greater than 45° relative to said axis, and the angularity of said first portion of said unit surface frusto-conical extent is less than 45° relative to said axis, whereby said certain recesses of both sets will constrict simultaneously during said inward displacement of the packer unit.

20. The unit of claim 6 wherein said polygonal cross sections are generally diamond shaped.

21. The unit of claim 14 wherein said polygonal cross sections are generally diamond shaped.

22. The unit of claim 11 wherein the packer has upper and lower surfaces and said axis extends generally vertically, the recesses of one of said sets located proximate said upper surface, and the recesses of the other set located proximate said lower surface.

23. The unit of claim 5 wherein said packer has upper and lower surfaces and said axis extends vertically, said recesses located between said upper and lower surfaces and projecting radially between circularly spaced webs defined by said inserts.

24. The unit of claim 23 wherein said recesses have generally circular cross sections in planes normal to the radial extents of the recesses.

25. In an annular blowout preventer packer unit having a longitudinal axis, the packer unit adapted to be compressed during axial advancement of a piston in a housing, the combination comprising (a) metallic inserts generally circularly spaced about said axis, the inserts having webs that extend generally longitudinally, and (b) an annulus of elastomeric material extending about said axis and embedding said webs so that the webs anchor the material during displacement thereof, the annulus having a bore, (c) the annulus having a first body section to be radially inwardly displaced by the piston during its axial advancement, and a second body section to be axially compressed by the piston during its advancement so that the second body section compressively engages inner surface extent of the housing, said first and second body sections being integral and in longitudinal alignment prior to said compression of the packer unit by the piston, (d) said first body section having a first-conical portion of lesser angularity relative to said axis and a second frusto-conical portion of greater angularity relative to said axis, said second portion having greater radial spacing from said axis than said first portion, said portions located radially outwardly of the webs, (e) said annulus containing first and second axially spaced sets of recesses spaced about said axis and extending generally radially outwardly from intersections with the annulus bore, the recesses adapted to be constricted in response to said inward displacement of the packer unit, (f) the packer having upper and lower surfaces and said axis extending generally vertically, the recesses of one of said sets located proximate said upper surface, and the recesses of the other set located proximate said lower surface, (g) the packer containing additional recesses spaced about said axis and extending generally radially outwardly from intersections with the annulus bore, said additional recesses located at a level intermediate the levels of said two sets of recesses.

26. The unit of claim 1 wherein said packer has upper and lower surfaces and said axis extends generally vertically, the inserts including upper plates and lower plates and upwardly extending webs interconnecting said upper and lower plates, the upper extents of the webs having inner surfaces facing radially inwardly toward said axis, said inner surfaces extending upwardly and inwardly to resist upward displacement of packer material below said inner surfaces in response to said inward displacement of the packer.

27. The unit of claim 26 wherein said web inner surfaces extend proximate the radially innermost extents of the upper plates.

28. The unit of claim 1 wherein said packer has upper and lower surfaces and said axis extends generally vertically, the inserts including upper plates and lower plates and upwardly extending webs interconnecting said upper and lower plates, the upper plates overhanging the webs in radially inward directions, the annulus of elastomeric material extending at the radially inward sides of the webs and upwardly toward said overhanging upper plates, and flaring generally toward the intersections of the web inner sides and the upper plates.

29. In an annular blowout preventer packer unit having a longitudinal axis, the packer adapted to be compressively displaced radially inwardly toward said axis and to engage surface extent of a housing facing toward said axis during axial advancement of a piston in the housing, the combination comprising (a) metallic inserts generally circularly spaced about said axis, the inserts having webs that extend generally longitudinally, and (b) an annulus of elastomeric material extending about said axis and embedding said webs so that the webs anchor the material during inward compressive displacement of the packer, the annulus having a bore, (c) the said annulus containing recesses spaced about said axis and extending generally radially outwardly from intersections with said annulus bore, said recesses adapted to be constricted in response to said inward displacement of the packer, and the inserts and recesses configured to resist well pressure induced longitudinal displacement toward one end of the packer unit of constricted elastomeric material, (d) the annulus having a first body section located to be radially inwardly displaced by the piston during its axial advancement, and a second body section located to be axially compressed by the piston during its advancement so that the second body section remains compressively engaged against said inner surface extent of the housing during said piston advancement, said first and second body sections being integral and in longitudinal alignment prior to said compression of the packer unit by the piston, (e) said first body section having a first frusto-conical portion of lesser angularity relative to said axis and a second frusto-conical portion of greater angularity relative to said axis, said second portion having greater radial spacing from said axis than said first portion, said portions located radially outwardly of the webs.

30. The packer of claim 24 wherein certain of said recesses have polygonal cross sections in planes normal to the radial extends of the certain recesses.

31. The packer of claim 30 wherein said certain recesses terminate in said elastomeric material.

32. The packer of claim 30 wherein said annulus contains slots communicating in the direction of said longitudinal axis between an end of the packer and said certain recesses.

33. The unit of claim 32 wherein said inserts include plates spaced about said axis and between said slots, and webs spaced about said axis and between said certain recesses.

34. The unit of claim 33 wherein said certain recesses are sized to constrict and block material extrusion into said slots, in response to inward displacement of the packer.

35. The unit of claim 29 wherein said recesses include first and second sets of axially spaced recesses.

36. The unit of claim 35 wherein the packer has upper and lower surfaces and said axis extends generally vertically, the recesses of one of said sets located proximate said upper surface, and the recesses of the other set located proximate said lower surface.

37. The unit of claim 30 wherein said polygonal cross sections are generally diamond shaped.

38. In an annular blowout preventer packer unit having a longitudinal axis, the packer adapted to be compressively displaced radially inwardly toward said axis, the combination comprising (a) metallic inserts generally circularly spaced about said axis, the inserts having webs that extend generally longitudinally, and (b) an annulus of elastomeric material extending about said axis and embedding said webs so that the webs anchor the material during inward compressive displacement of the packer, the annulus having a bore, (c) the said annulus containing recesses spaced about said axis and extending generally radially outwardly from intersections with said annulus bore, said recesses adapted to be constricted in response to said inward displacement of the packer, and the inserts and recesses configured to resist well pressure induced longitudinal displacement toward one end of the packer unit of constricted elastomeric material, (d) said recesses including first and second sets of axially spaced recesses, (e) the packer having upper and lower surfaces and said axis extending generally vertically, the recesses of one of said sets located proximate said upper surface, and the recesses of the other set located proximate said lower surface, (f) the packer containing additional recesses spaced about said axis and extending generally radially outwardly from intersections with the annulus bore, said additional recesses located at a level intermediate the levels of said two sets of recesses.

39. The unit of claim 29 wherein said packer has upper and lower surfaces and said axis extends generally vertically, the inserts including upper plates and lower plates and upwardly extending webs interconnecting said upper and lower plates, the upper extents of the webs having inner surfaces facing radially inwardly toward said axis, said inner surfaces extending upwardly and inwardly to resist upward displacement of packer material below said inner surfaces in response to said inward displacement of the packer.

40. The unit of claim 29 wherein said packer has upper and lower surfaces and said axis extends generally vertically, the inserts including upper plates and lower plates and upwardly extending webs interconnecting said upper and lower plates, the upper plates overhanging the webs in radially inward direction, the annulus of elastomeric material extending at the radially inward sides of the webs and upwardly toward said overhanging upper plates, and to flare generally toward the intersections of the webs inner sides and the upper plates.

41. In an annular blowout preventer packer unit having a longitudinal axis, the packer adapted to be compressively displaced radially inwardly toward said axis and to engage surface extent of a housing facing toward said axis during axial advancement of a piston in the housing, the combination comprising (a) metallic inserts generally circularly spaced about said axis, the inserts having webs that extend generally longitudinally, and (b) an annulus of elastomeric material extending about said axis and embedding said webs so that the webs anchor the material during inward compressive displacement of the packer, the annulus having a bore, (c) the packer having upper and lower surfaces and said axis extending generally vertically, the inserts including upper plates and lower plates and upwardly extending webs interconnecting said upper and lower plates, the upper extents of the webs having inner surfaces facing radially inwardly toward said axis, said inner surfaces extending upwardly and inwardly to resist upward displacement of packer material below said inner surfaces, in response to said inward displacement of the packer, (d) the packer having a first body section to be radially displaced and a second body section to be axially compressive and to engage said housing inner surface extent during said piston advancement, (e) said first body section having a first frusto-conical portion of lesser angularity relative to said axis and a second frusto-conical portion of greater angularity relative to said axis, said second portion having greater radial spacing from said axis than said first portion, said portions located radially outwardly of the webs.

42. The unit of claim 41 wherein the annulus contains recesses spaced about said axis and extending generally radially outwardly from intersections with the annulus bore, said recesses adapted to be constricted in response to said inward displacement of the packer unit.

43. The unit of claim 42 wherein said recesses are located between said upper and lower surfaces and project radially between said webs.

44. The unit of claim 43 wherein said recesses have generally circular cross sections in planes normal to the radial extents of the recesses.

45. Metallic inserts usable in an annular blowout preventer packer unit having a longitudinal axis, the packer comprising an annular elastomeric body carrying said inserts, and adapted to be compressively displaced radially inwardly toward said axis, each of said inserts comprising (a) top and bottom plates and a generally longitudinally extending web interconnecting said plates, (b) the uppermost extent of the web extending proximate the radially innermost extent of the upper plate to resist upward displacement of packer material in response to said inward displacement of the packer, (c) each top plate having opposite sides which are upwardly tapered, said opposite sides also tapering relatively toward one another in horizontal directions.

46. The inserts of claim 45 which have upper extents with radially inwardly facing surfaces extending upwardly and inwardly.

47. The inserts of claim 45 wherein each bottom plate has opposite sides which are downwardly tapered, said opposite sides also tapering toward one another in horizontal directions.

48. The combination of claim 3 including an annular housing in which said unit and piston are received, the housing containing a vertical opening to pass well pipe.

49. The combination of claim 4 including an annular housing in which said unit and piston are received, the housing containing a vertical opening to pass well pipe.

50. The unit of claim 1 wherein said packer has upper and lower surfaces and said axis extends vertically, the annulus containing a recess extending about said axis and extending generally radially outwardly from the annulus bore, said recess located between said upper and lower surfaces, said recess adapted to be constricted in response to said inward displacement of the packer unit first body portion.

51. The combination of claim 50 wherein the recess extends annularly about said axis.

52. In combination, (a) an annular blowout preventer packer unit having a longitudinal axis, said unit including metallic inserts generally circularly spaced about said axis, the inserts having webs that extend generally longitudinally, and said unit also including an annulus of elastomeric material extending about said axis and embedding said webs so that the webs anchor the elastomeric material during inward compressive displacement of the material, the annulus having a bore, (b) a housing in which said unit is received, and a piston movable longitudinally in the housing to effect said inward compressive displacement of the material, (c) said annulus of elastomeric material having longitudinally spaced first and second body sections located radially outwardly of the webs, in a retracted position of the piston, said piston having an advanced position in which said first body section of the packer is radially inwardly displaced by the piston, and said second body section of the packer is longitudinally compressed by the piston to compressively engage radially inwardly facing inner surface extent of the housing, (d) said first body section having a first frusto-conical portion of lesser angularity relative to said axis and a second frusto-conical portion of greater angularity relative to said axis, said second portion having greater radial spacing from said axis than said first portion, said portions located radially outwardly of the webs.

53. The combination of claim 52 wherein the second body section has greater overall radial dimension in said piston advanced position than in said piston retracted position.

54. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) an annulus of elastomeric material having a bore formed therethrough, said annulus forming an inner sealing surface adapted for sealing engagement with an object positioned in the annular blowout preventer or upon itself to block leakage of well fluids therebetween when said annulus is radially contracted;

(b) a plurality of metallic inserts substantially equicircumferentially spaced within said annulus, said inserts embedded within said annulus for structurally reinforcing said elastomeric material and controlling elastomeric material movement during radial contraction of said annulus;

(c) said annulus having an exterior surface engageable by a movable operating member of the blowout preventer for radially contracting said annulus upon predetermined movement of the operating member, said exterior surface shaped for effecting a predetermined pressure containing seal by establishing a localized sealing contact area on said inner sealing surface by a controlled feeding of said inner sealing surface radially inwardly in response to the predetermined movement of the operating member and controlled elastomeric material movement, (d) the annulus having a first body section located to be radially inwardly displaced by the said operating member during its axial advancement, and a second body section located to be axially compressed by the piston during its advancement so that the second body section remains compressively engaged against said inner surface extent of the housing during said operating member advancement, said first and second body sections being integral and in longitudinal alignment prior to said compression of the packer unit by the piston, (e) said first body section having a first frusto-conical portion of lesser angularity related to said axis and a second frusto-conical portion of greater angularity relative to said axis, said second portion having greater radial spacing from said axis than said first portion, said portions located radially outwardly of the webs, 55. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) an annulus of elastomeric material having a bore formed therethrough, said annulus forming an inner sealing surface adapted for sealing engagement with an object positioned in the annulus blowout preventer to block leakage of well fluids therebetween when said annulus is radially contracted;

(b) a plurality of metallic inserts substantially equicircumferentially spaced within said annulus, said inserts embedded within said annulus for structurally reinforcing said elastomeric material and controlling elastomeric material movement during radial contraction of said annulus;

(c) said annulus having an exterior surface engageable by a movable operating member of the blowout preventer for radially contracting said annulus upon predetermined movement of the operating member, said exterior surface formed to provide a controlled feeding of the sealing surface radially inwardly responsive to elastomeric material movement in response to the movement of the operating member for effecting a pressure containing seal by shaping a localized sealing contact area on said sealing surface;

(d) the annulus having a first body section located to be radially inwardly displaced by the said operating member during its axial advancement, and a second body section located to be axially compressed by the piston during its advancement so that the second body section remains compressively engaged against said inner surface extent of the housing during said operating member advancement, said first and second body sections being integral and in longitudinal alignment prior to said compression of the packer unit by the piston;

(e) said first body section having a first frusto-conical portion of lesser angularity related to said axis and a second frusto-conical portion of greater angularity relative to said axis, said second portion having greater radial spacing from said axis than said first portion, said portions located radially outwardly of the webs.

56. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) annulus of elastomeric material having a bore formed therethrough, said annulus forming an inner sealing surface adapted for sealing engagement with an object positioned in the annulus blowout preventer or upon itself to block leakage of well fluids therebetween when said annulus is radially contracted;

(b) a plurality of metallic inserts substantially equicircumferentially spaced within said annulus, said inserts embedded within said annulus for structurally reinforcing said elastomeric material and controlling elastomeric material movement during radial contraction of said annulus;

(c) said annulus having an exterior surface engageable by a movable operating member of the blowout preventer for radially contracting said annulus upon predetermined movement of the operating member;

(d) said inserts having webs formed thereon for controlling the movement of said elastomeric material adjacent said inserts to optimize the sealing contact engagement portion of said inner surface in response to the radially contracting movement of said annulus, (e) the annulus having a first body section located to be radially inwardly displaced by the said operating member during its axial advancement, and a second body section located to be axially compressed by the piston during its advancement so that the second body section remains compressively engaged against said inner surface extent of the housing during said operating member advancement, said first and second body sections being integral and in longitudinal alignment prior to said compression of the packer unit by the piston, (f) said first body section having a first frusto-conical portion of lesser angularity related to said axis and a second frusto-conical portion of greater angularity relative to said axis, said second portion having greater radial spacing from said axis than said first portion, said portions located radially outwardly of the webs.

57. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) an annulus of elastomeric material having a bore formed therethrough, said annulus forming an inner sealing surface adapted for effecting a sealing engagement in the annular blowout preventer to block leakage of well fluids when said annulus is sufficiently radially contracted;

(b) a plurality of metallic inserts substantially equicircumferentially spaced within said annulus, said inserts embedded within said annulus for reinforcing said elastomeric material during radial contraction;

(c) said annulus having an exterior surface engageable by a movable operating member of the blowout preventer for radially contracting said annulus upon predetermined movement of the operating member;

(d) said inner sealing surface having a prearranged plurality of spaced recesses formed therein to prevent damaging of the elastomeric material upon sufficient radial contraction of said annulus for effecting a seal, (e) the annulus having a first body section located to be radially inwardly displaced by the said operating member during its axial advancement, and a second body section located to be axially compressed by the piston during its advancement so that the second body section remains compressively engaged against said inner surface extent of the housing during said operating member advancement, said first and second body sections being integral and in longitudinal alignment prior to said compression of the packer unit by the piston, (f) said first body section having a first frusto-conical portion of lesser angularity related to said axis and a second frusto-conical portion of greater angularity relative to said axis, said second portion having greater radial spacing from said axis than said first portion, said portions located radially outwardly of the webs.

58. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) an annulus of elastomeric material having a bore formed therethrough, said annulus forming inner sealing surface adapted for effecting a sealing engagement in the annular blowout preventer block leakage of well fluids therebetween when said annulus is radially contracted;

(b) a plurality of metallic inserts substantially equicircumferentially spaced within said annulus, said inserts embedded within said annulus for reinforcing said elastomeric material and controlling elastomeric material movement during radial contraction of said annulus;

(c) said annulus having an exterior surface engageable by a movable operating member of the blowout preventer for radially contracting said annulus in a controlled manner of movement of said sealing surface upon predetermined movement of the operating member;

(d) said inner sealing surface having a prearranged plurality of recesses formed therein to prevent tearing of the elastomeric material upon sufficient sealing radial contraction of said annulus for sealing in the annular blowout preventer;

(e) the annulus having a first body section located to be radially inwardly displaced by the said operating member during its axial advancement, and a second body section located to be axially compressed by the piston during its advancement so that the second body section remains compressively engaged against said inner surface extent of the housing during said operating member advancement, said first and second body sections being integral and in longitudinal alignment prior to said compression of the packer unit by the piston, (f) said first body section having a first frusto-conical portion of lesser angularity related to said axis and a second frusto-conical portion of greater angularity relative to said axis, said second portion having greater radial spacing from said axis than said first portion, said portions located radially outwardly of the webs.

59. A packing unit adapted for use in an annular blowout preventer having a housing to effect a desired well fluid pressure containing seal by radially contracting the packing unit with the packing unit engaging surface extent of the housing facing inwardly toward an axis defined by the packing unit, including:

(a) an annulus of elastomeric material having a bore formed therethrough, said annulus forming an inner sealing surface adapted for effecting a sealing engagement in the annular blowout preventer to block leakage of well fluids when said annulus is radially contracted a sufficient amount;

(b) a plurality of metallic inserts substantially equicircumferentially spaced within said annulus, said inserts embedded within said annulus for reinforcing said elastomeric material and for controlling movement of the elastomeric material for feeding the sealing surface inwardly in a desired sealing manner during radial contraction of said annulus;

(c) said annulus having a first exterior surface portion engageable by a movable operating member of the blowout preventer for radially contracting said annulus upon predetermined movement of the operating member, said first exterior surface portion shaped to provide a controlled feeding of the sealing surface radially inwardly responsive to movement of the operating member for effecting a localized pressure containing seal on said sealing surface; and (d) said annulus having a second exterior surface portion substantially fully supported by the blowout preventer to protect the elastomeric material from damage during radial contraction of the annulus by the movable operating member to move the inner sealing surface into sealing contact, (e) said first exterior surface portion being respectively characterized as having surfaces of lesser and greater frusto-conical angularity relative to said axis, and as having lesser and greater spacing from said axis, said annulus second exterior surface portion remaining in engagement with said surface extent of the housing during movement of said operating member.

60. A packing unit adapted for use in an annular blowout preventer having a housing to effect a desired well fluid pressure containing seal by radially contracting the packer unit with the packing unit engaging surface extent of the housing facing inwardly toward an axis defined by the packing unit, including:

(a) an annulus of elastomeric material having a bore formed therethrough, said annulus forming inner sealing surface adapted for sealing engagement with an object positioned in the annular blowout preventer or upon itself to block leakage of well fluids therebetween when said annulus is radially contracted;

(b) a plurality of metallic inserts substantially equicircumferentially spaced within said annulus, said inserts embedded within said annulus for reinforcing said elastomeric material and for controlling movement of the elastomeric material for feeding the sealing surface inwardly in a desired sealing manner during radial contraction of the annulus;

(c) said annulus having a first exterior surface portion engagement by a movable operating member of the blowout preventer for radially contracting said annulus upon predetermined movement of the operating member, said first exterior surface portion shaped to provide a controlled feeding of the sealing surface radially inwardly responsive to movement of the operating member for effecting a localized pressure containing seal on said sealing surface; and (d) said annulus having a second exterior surface portion substantially fully supported by the blowout preventer during radial contraction of the annulus by the movable operating member to move the inner sealing surface into sealing engagement without subjecting the second exterior surface to a localized elastomer stress that is operable damaging to annulus, (e) said first exterior surface portion being respectively characterized as having surfaces of lesser and greater frusto-conical angularity relative to said axis, and as having lesser and greater spacing from said axis, said annulus second exterior surface portion remaining in engagement with said surface extent of the housing during movement of said operating member.

61. An annular blowout preventer packing unit apparatus forming a longitudinal axis, the packer unit apparatus adapted to be compressively displaced radially inwardly toward said longitudinal axis by operation of a blowout preventer to effect a fluid seal, the preventer having a housing with an inner surface engaged by the packer unit including:

(a) an annulus of elastomeric material disposed bout a longitudinal axis, said annulus having an inner sealing surface defining a bore extending therethrough with said inner sealing surface positioned substantially uniformly from said axis, (b) a plurality of metallic reinforcing inserts substantially equi-circumferentially spaced about said axis and concentrically embedded within said annulus, each of said inserts having a web for controlling movement of said elastomeric material during radial inward displacement of said annulus by the blowout preventer;

(c) said annulus having a first exterior surface portion characterized as having surfaces of respectively lesser and greater frusto-conical angularity relative to said axis, and as having lesser and greater spacing from said axis, and said annulus having a second exterior surface portion substantially fully supported during radial contraction of the annulus and in engagement with said surface extent of the housing to prevent damage to the elastomeric material by operation of the blowout preventer; and (d) said annulus compressively displaced during operation of the blowout preventer to shape the sealing surface to provide a prearranged localized portion of initial sealing contact to minimize elastomeric movement needed to effect the desired seal.

62. For use in combination with an annular blowout preventer packer unit having a longitudinal axis, the packer unit adapted to be compressed during axial advancement of a piston in a housing, and to engage surface extent of the housing facing inwardly toward said axis, the packer unit comprising:

(a) metallic inserts generally circularly spaced about said axis, the inserts having webs that extend generally longitudinally, and (b) an annulus of elastomeric material extending about said axis and embedding said webs so that the webs anchor the material during displacement thereof, the annulus having a bore, (c) the annulus having a first body section located to be radially inwardly displaced by the piston during its axial advancement, and a second body section located to be axially compressed by the piston during its advancement so that the second body section remains compressively engaged against said inner surface extent of the housing during said piston advancement, said first and second body sections being integral and in longitudinal alignment prior to said compression of the packer unit by the piston, the improvement comprising (d) said piston having a first interior frusto-conical surface portion of relatively lesser angularity in axial radial planes to engage a first body portion of the annulus first body section, and the piston having a second interior frusto-conical surface portion of relatively greater angularity in axial radial planes and to engage a second body portion of said annulus first body section.

* * * * *